US012276286B2

(12) United States Patent
Zhang et al.

(10) Patent No.: US 12,276,286 B2
(45) Date of Patent: Apr. 15, 2025

(54) REFRIGERANT COMPRESSOR WITH IMPELLER HAVING SLOTTED SHROUD

(71) Applicant: Danfoss A/S, Nordborg (DK)

(72) Inventors: Tianli Zhang, Ann Arbor, MI (US); Jin Yan, Tallahassee, FL (US); Jose Manuel Urcia, Land O Lakes, FL (US)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 18/274,064

(22) PCT Filed: Apr. 12, 2022

(86) PCT No.: PCT/US2022/024374

§ 371 (c)(1),
(2) Date: Jul. 25, 2023

(87) PCT Pub. No.: WO2022/225743

PCT Pub. Date: Oct. 27, 2022

(65) Prior Publication Data

US 2024/0426318 A1 Dec. 26, 2024

Related U.S. Application Data

(60) Provisional application No. 63/189,277, filed on May 17, 2021, provisional application No. 63/177,418, filed on Apr. 21, 2021.

(51) Int. Cl.

| | |
|---|---|
| ***F04D 29/44*** | (2006.01) |
| ***F04D 17/10*** | (2006.01) |
| ***F04D 29/28*** | (2006.01) |

(52) U.S. Cl.

CPC ..... *F04D 29/441* (2013.01); *F04D 17/10* (2013.01); *F04D 29/284* (2013.01)

(58) Field of Classification Search

CPC .... F04D 17/10; F04D 27/0207; F04D 29/285; F04D 29/40; F04D 29/403; F04D 29/42; F04D 29/4206; F04D 29/66; F04D 29/661; F04D 29/68; F04D 29/684; F04D 29/685

See application file for complete search history.

(56) References Cited

U.S. PATENT DOCUMENTS 3,217,655 A * 11/1965 Michel ..... F04D 15/00 415/147
3,226,940 A 1/1966 Jekat et al.
4,642,023 A * 2/1987 Dunn ..... F04D 29/669 415/58.7
7,025,557 B2 * 4/2006 Japikse ..... F04D 27/0207 415/58.4

(Continued)

FOREIGN PATENT DOCUMENTS

DE 10223876 A1 * 12/2003 ..... F01D 5/048

OTHER PUBLICATIONS

International Search Report and Written Opinion for application No. PCT/US2022/024374 mailed Jul. 8, 2022.

*Primary Examiner* — Brian P Wolcott
(74) *Attorney, Agent, or Firm* — Carlson, Gaskey & Olds, P.C.

(57) ABSTRACT

In some aspects, the techniques described herein relate to a refrigerant compressor, including: a shrouded impeller including a passageway permitting refrigerant to flow from a location radially outside a shroud of the shrouded impeller to a location radially inside the shroud.

10 Claims, 4 Drawing Sheets

(56) References Cited

U.S. PATENT DOCUMENTS

| | | | | |
|---|---|---|---|---|
| 9,394,913 | B2 * | 7/2016 | Taguchi | F04D 29/682 |
| 10,436,211 | B2 * | 10/2019 | McArdle | F01D 5/048 |
| 2014/0202202 | A1 * | 7/2014 | Taguchi | F04D 29/4213 415/58.3 |
| 2016/0123639 | A1 | 5/2016 | Koga et al. | |
| 2018/0045214 | A1 * | 2/2018 | McArdle | F02B 37/00 |
| 2020/0208642 | A1 | 7/2020 | Yan et al. | |

* cited by examiner

REFRIGERANT COMPRESSOR WITH IMPELLER HAVING SLOTTED SHROUD

BACKGROUND

Refrigerant compressors are used to circulate refrigerant in a chiller via a refrigerant loop. Refrigerant loops are known to include a condenser, an expansion device, and an evaporator. The compressor compresses the fluid, which then travels to a condenser, which in turn cools and condenses the fluid. The refrigerant then goes to an expansion device, which decreases the pressure of the fluid, and to the evaporator, where the fluid is vaporized, completing a refrigeration cycle.

Many refrigerant compressors are centrifugal compressors and have an electric motor that drives at least one impeller to compress refrigerant. Fluid flows into the impeller in an axial direction, and is expelled radially from the impeller. The fluid is then directed downstream for use in the chiller system. Some known refrigerant compressors include shrouded impellers which include a circumferentially-extending shroud, or wall, connecting the tips of the impeller blades while permitting refrigerant to flow in and out of the impeller.

SUMMARY

In some aspects, the techniques described herein relate to a refrigerant compressor, including: a shrouded impeller including a passageway permitting refrigerant to flow from a location radially outside a shroud of the shrouded impeller to a location radially inside the shroud.

In some aspects, the techniques described herein relate to a refrigerant compressor, wherein the passageway is a slot.

In some aspects, the techniques described herein relate to a refrigerant compressor, wherein the slot is spaced axially between a leading edge and a trailing edge of the shrouded impeller.

In some aspects, the techniques described herein relate to a refrigerant compressor, wherein: the shrouded impeller includes a plurality of main blades, the shrouded impeller includes a splitter blade between adjacent ones of the main blades, and the slot is arranged downstream of leading edges of the main blades and upstream of a leading edge of the splitter blade.

In some aspects, the techniques described herein relate to a refrigerant compressor, wherein the slot extends through the shroud at a non-90° angle relative to an axis of rotation of the shrouded impeller.

In some aspects, the techniques described herein relate to a refrigerant compressor, wherein the slot extends through the shroud at an angle substantially perpendicular to a contour of tips of blades of the shrouded impeller at an axial location of the slot.

In some aspects, the techniques described herein relate to a refrigerant compressor, wherein an outer wall of the shroud provides a portion of a seal assembly at an axial location between a leading edge of the shrouded impeller and the slot.

In some aspects, the techniques described herein relate to a refrigerant compressor, wherein the slot is one of a plurality of slots of the shrouded impeller.

In some aspects, the techniques described herein relate to a refrigerant compressor, wherein the passageway is a series of holes.

In some aspects, the techniques described herein relate to a refrigerant compressor, wherein the shrouded impeller includes a plurality of series of holes.

In some aspects, the techniques described herein relate to a refrigerant compressor, wherein each of the plurality of series of holes are axially aligned with one another and are circumferentially spaced-apart relative to one another.

In some aspects, the techniques described herein relate to a refrigerant compressor, wherein the holes are formed by drilling.

In some aspects, the techniques described herein relate to a refrigerant compressor, wherein, within each series of holes, each of the holes are spaced-apart by an amount equal to about one-fourth of a diameter of the holes.

In some aspects, the techniques described herein relate to a refrigerant compressor, wherein each of the series of holes includes between 8 and 10 holes.

In some aspects, the techniques described herein relate to a method, including: operating refrigerant compressor including a shrouded impeller such that the shrouded impeller rotates within a housing; and directing leakage flow between the shrouded impeller and the housing back into the shrouded impeller through a passageway extending radially through a shroud of the shrouded impeller.

DETAILED DESCRIPTION

Figure 1:
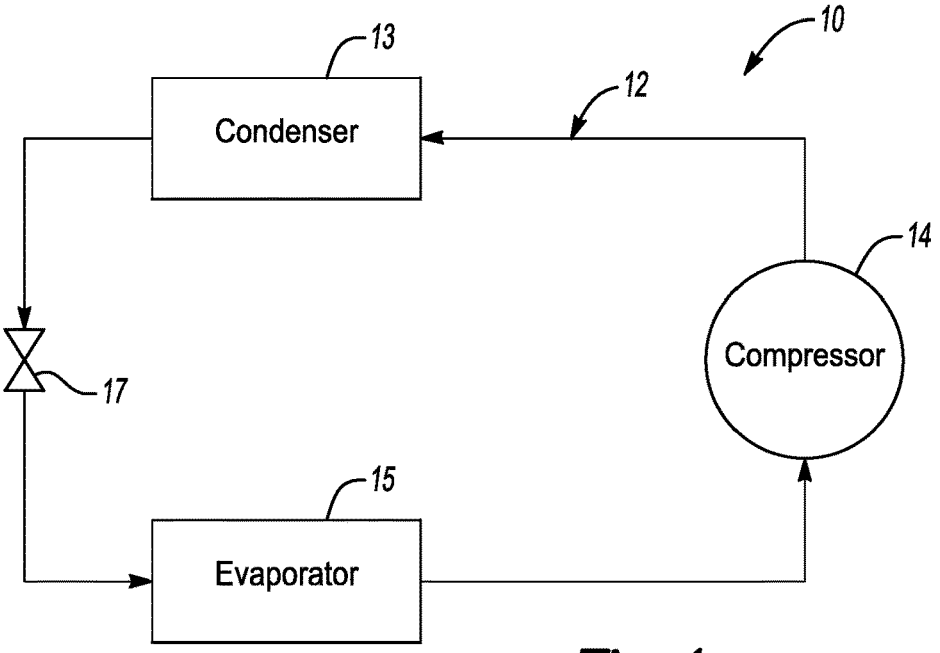
FIG. 1 schematically illustrates a refrigerant system.

FIG. 1 illustrates a refrigerant system 10. The refrigerant system 10 includes a main refrigerant loop, or circuit, 12 in communication with a refrigerant compressor 14, a condenser 13, an evaporator 15, and an expansion device 17. This refrigerant system 10 may be used in a chiller, for example. In that example, a cooling tower may be in fluid communication with the condenser 13. While a particular example of the refrigerant system 10 is shown, this application extends to other refrigerant system configurations, including configurations that do not include a chiller. For instance, the main refrigerant loop 12 can include an economizer downstream of the condenser 13 and upstream of the expansion device 17.

Figure 2:
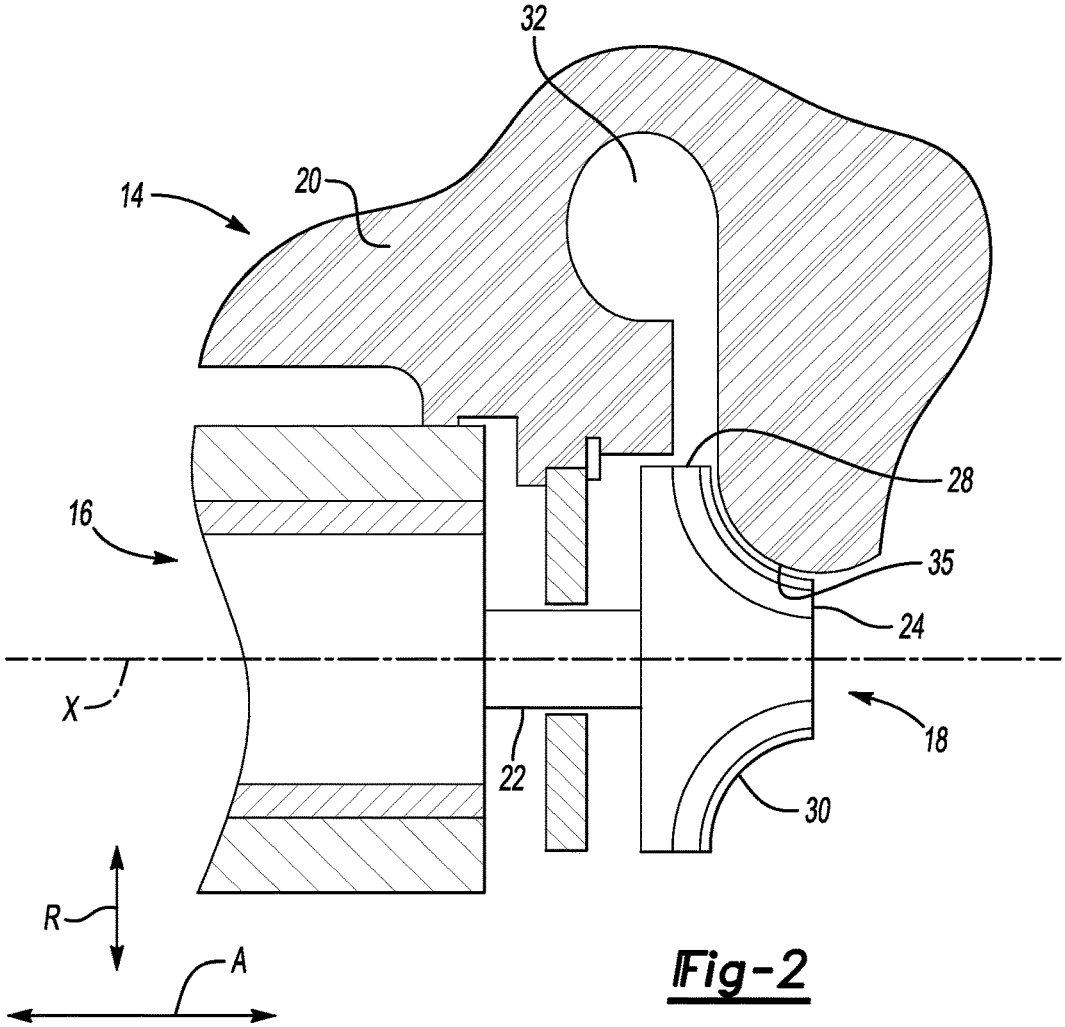
FIG. 2 schematically illustrates, in cross-section, a portion of an example refrigerant compressor.

FIG. 2 schematically illustrates an example refrigerant compressor 14 according to this disclosure. The refrigerant compressor 14 includes a housing 20 within which an electric motor 16 is arranged. The housing 20 is schematically depicted and may comprise one or more pieces. The electric motor 16 rotationally drives an impeller 18 via a rotor shaft 22 about a central axis X to compress refrigerant. The rotor shaft 22 may comprise one or more pieces. The illustrated refrigerant compressor 14 is a centrifugal compressor, meaning, among other things, that the impeller 18 is configured to expel fluid in a direction away from the axis of rotation, which here is the axis X of the shaft 22. In particular, the impeller 18 has an outlet 28 radially outward of an inlet 24, with the outlet 28 axially spaced downstream of the inlet 24. The compressed refrigerant then exits the refrigerant compressor 14 via an outlet volute 32. While reference herein is made to a refrigerant compressor 14, this disclosure is not limited to any one particular working fluid, and extends to systems configured for other fluids such as air, water, etc.

In this example, the impeller 18 is a shrouded impeller. That is, a circumferentially-extending shroud 30, or wall, partially encases the impeller 18 and, in particular, connects tips of blades of the impeller, thereby adding rigidity to the blades. In this disclosure, the term "impeller" is used to refer to a central hub and the impeller blades projecting from that hub, and does not refer to a shroud. However, in this art field, an assembly including a hub, blades, and shroud is sometimes collectively referred to as an "impeller" as shorthand for a "shrouded impeller." In this disclosure, an assembly including a hub, blades, and shroud will be referred to as a shrouded impeller, an impeller assembly, or simply an assembly. The shroud 30 is permanently attached to the impeller 18 by brazing, in an example. The impeller 18 and shroud 30 rotate together with the shaft 22.

Figure 3:
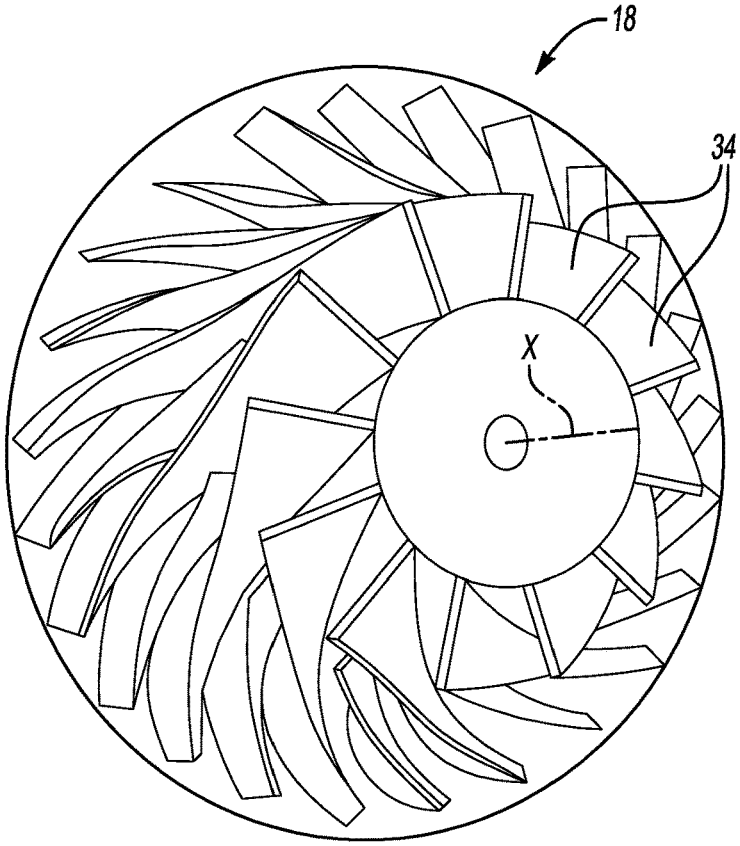
FIG. 3 illustrates an example impeller.

FIG. 3 illustrates an example impeller 18. The impeller 18 has a plurality of blades 34 arranged circumferentially about the central axis X. The blades 34 direct the refrigerant between the inlet 24 and the outlet 28 as the refrigerant is compressed.

Figure 4:
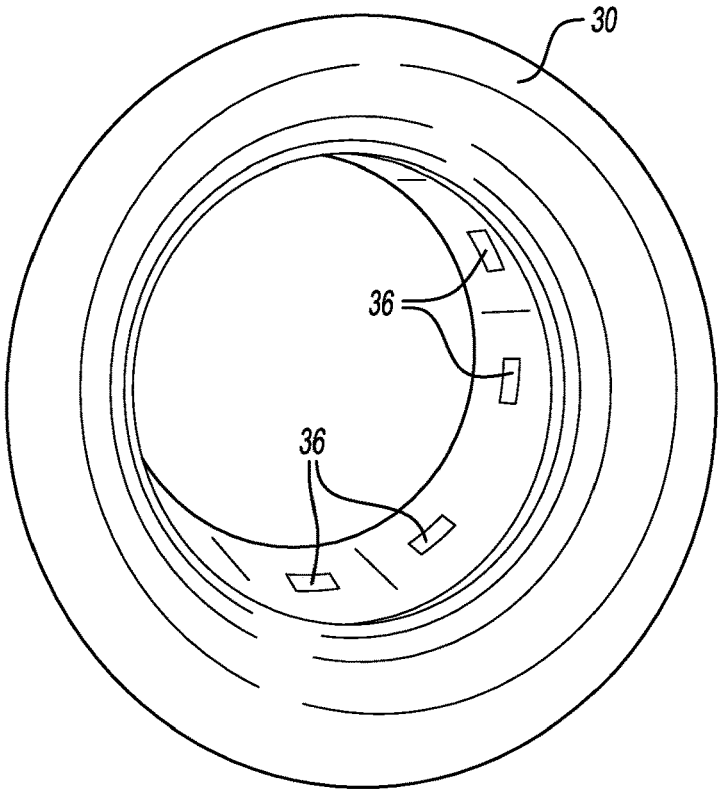
FIG. 4 illustrates an example shroud.

FIG. 4 illustrates an example shroud 30. The shroud 30 fits over the impeller 18 and contacts tips of the blades 34. The shroud 30 and the impeller 18 may be metallic components, for example. The shroud 30 and the impeller 18 may be the same material, or may be different materials.

During operation of the refrigerant compressor 14, fluid is expelled radially from the outlet 28 of the impeller 18. As generally discussed above, a majority of the expelled flow travels downstream toward a diffuser and ultimately to the volute 32. Some flow, however, leaks between a gap 35 (FIG. 6) between the impeller 18 and the housing 20 and flows within that gap 35 generally from a location adjacent the outlet 28 back toward the inlet 24. Various seals may be in place in an attempt to reduce such leakage. In this disclosure, the shroud 30 is configured to re-introduce the leakage flow into the impeller 18, and specifically into the main flow path of the impeller 18, which is inside the shroud 30 and between the blades 34.

Figure 5:
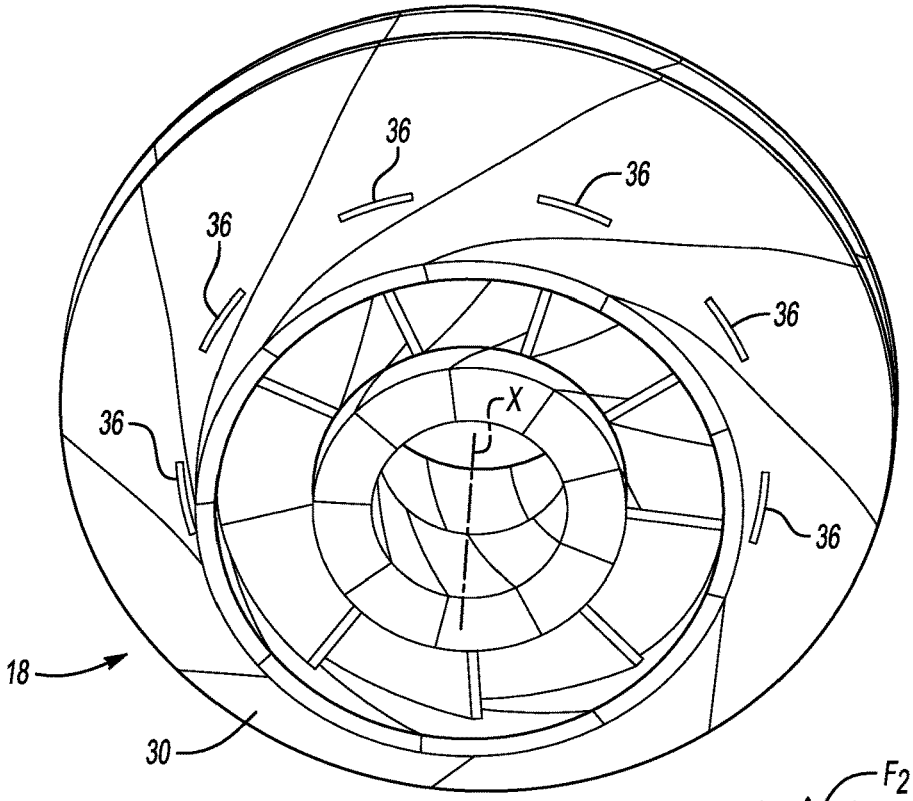
FIG. 5 is a perspective, end view of an example shrouded impeller.

The shroud 30, in this example, includes a plurality of slots 36 extending radially through the shroud 30 to permit fluid to flow from a location radially outside the shroud 30 to a location radially inside the shroud 30, at which point that fluid joins fluid within the impeller 18. The slots 36 are circumferentially spaced-apart from one another about the axis X (FIG. 5). The slots 36 may be referred to as channels.

Figure 6:
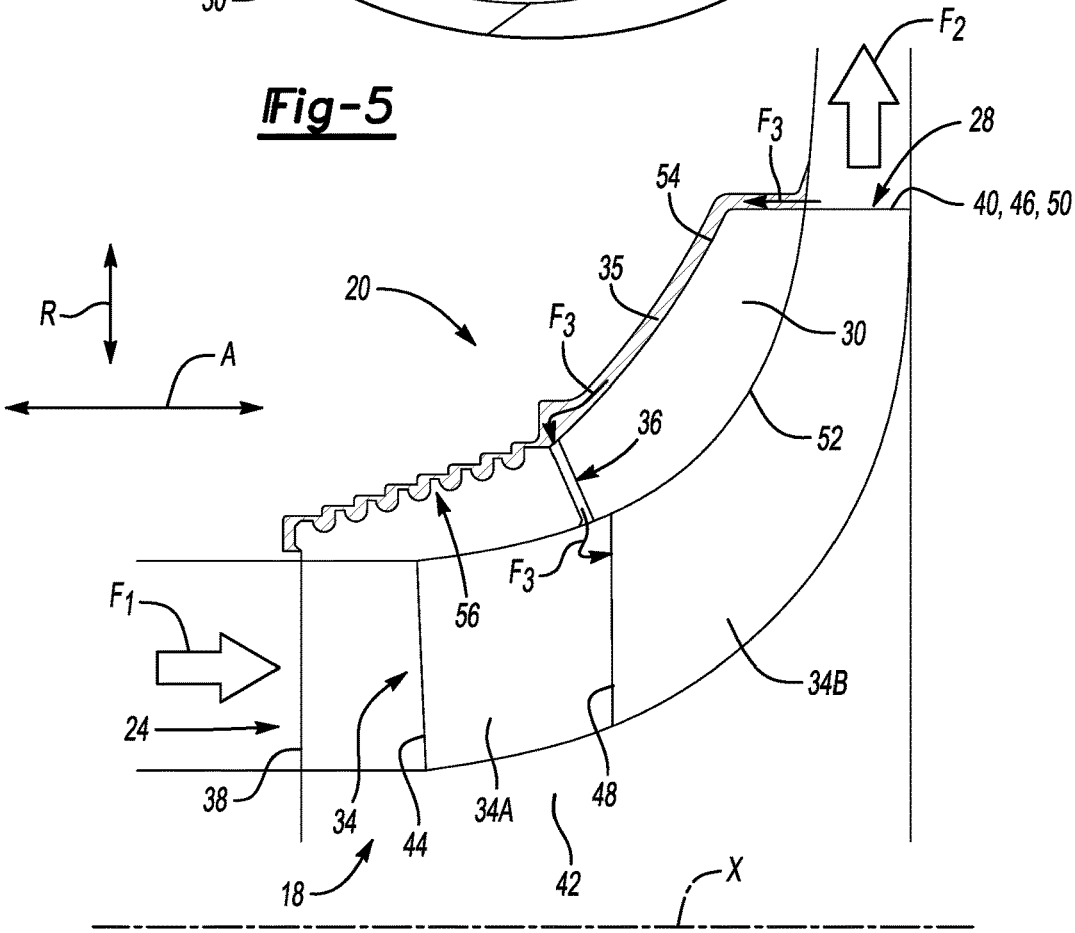
FIG. 6 schematically illustrates, in cross-section, an example arrangement of the shrouded impeller of FIG. 5.

An example arrangement of the slots 36 will now be described with reference to FIGS. 5 and 6. In this example, the impeller 18 extends between a leading edge 38 and a trailing edge 40. The impeller 18 includes a central hub 42 and two different types of blades 34, in this example, extending between the central hub 42, at their roots, and the shroud 30, at their tips. In particular, the impeller 18 includes main blades 34A extending axially between a leading edge 44 spaced-apart axially rearward of the leading edge 38 and a trailing edge 46 substantially coextensive with the trailing edge 40. The impeller 18 further includes splitter blades 34B, with one splitter blade 34B between adjacent ones of the main blades 34A to provide an alternating arrangement, extending axially between a leading edge 48 spaced-apart axially rearward of the leading edge 44 and a trailing edge 50 substantially coextensive with the trailing edges 40, 46.

The slots 36 may be rectangularly-shaped in cross-section, with a length dimension of the rectangular shape substantially corresponding to the circumferential distance between adjacent main blades 34A of the impeller 18. The slots 36 may exhibit other shapes in cross-section, however.

The shroud 30, in this example, exhibits a wall thickness between an inner wall 52 and an outer wall 54. The inner wall 52 faces and provides a boundary of the main flow path of the impeller 18. The inner wall 52 also contacts tips of the blades 34. The outer wall faces and provides an inner boundary of the gap 35. In this example, the slots 36 extend completely through the wall thickness of the shroud 30 from the inner wall 52 to the outer wall 54. In this way, fluid within the gap 35 is able to flow through the slots 36 from the gap 35 back to the main flow path.

The slots 36 are arranged, in this example, such that the slots 36 are spaced axially between the leading edge 38 and the trailing edge 40 of the impeller 18. Further, the slots 36 are arranged such that the slots 36 intersect with the inner wall 54 at a location downstream of the leading edges 44 of the main blades 34A and upstream of the leading edges 48 of the splitter blades 34B. The slots 36 could be provided at another location, such as upstream of the leading edges 44 or downstream of the leading edges 48.

The slots 36 are inclined at a non-90° angle relative to the axis X such that the slots 36 extend substantially perpendicular to the contour of the tips of the main and splitter blades 34A, 34B at the location of the slots 36. The slots 36 could be inclined in another manner, in other examples.

Axially between the slots 36 and the leading edge 38 of the impeller 18, the outer wall 54 and the housing 20 are configured to provide a seal assembly 56. In this example, the outer wall 54 includes a plurality of knife edge seals and the housing 20 includes a plurality of lands corresponding to and configured to interface with the knife edge seals. The seal assembly 56 could exhibit another arrangement. The seal assembly 56 serves to direct fluid within the gap 35 toward the slots 36, and ultimately toward the main flow path of the impeller 18.

During operation of the refrigerant compressor 14, fluid $F_1$, namely refrigerant, enters the inlet 24 of the impeller 18, flows along the main flow path of the impeller 18, and is pressurized and expelled from the outlet 28. A majority of the fluid $F_1$, here labeled as $F_2$, flows to a diffuser and then to a downstream location, such as the volute 32. A portion, labeled as $F_3$, of the fluid $F_1$ leaks and flows into the gap 35. That portion $F_3$ is redirected into the main flow path of the impeller 18 via the slots 36, in this disclosure. In an example, about 3% of the fluid $F_1$ becomes the portion $F_3$. Recirculating fluid within the gap 35 back into the impeller 18 improves the surge domain of the refrigerant compressor 14 in a passive manner, meaning there are no actively controlled mechanisms, such as valves, dictating flow through the gap 35 and/or the slots 36.

Figure 7:
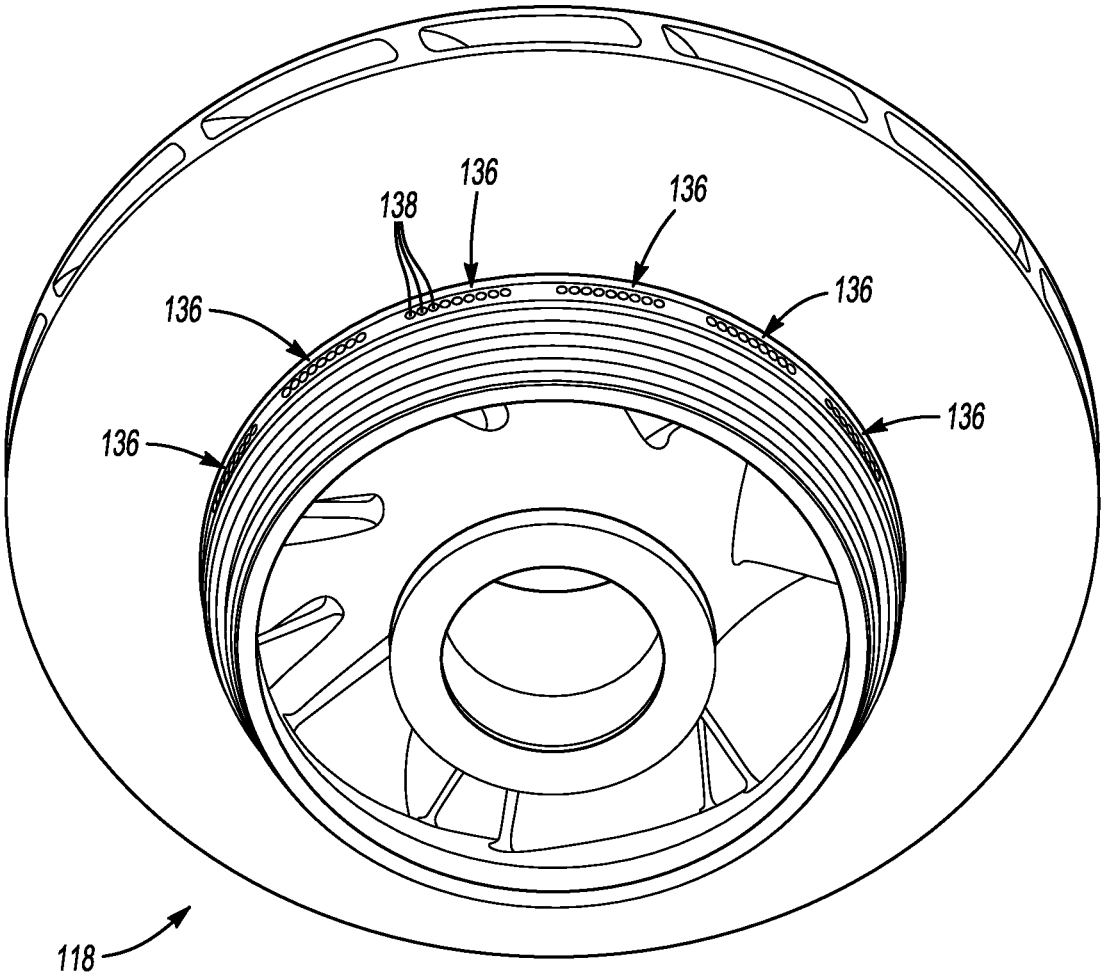
FIG. 7 is a perspective, end view of another example shrouded impeller.

FIG. 7 illustrates an example impeller 118 configured substantially the same as impeller 18 but instead of slots 36 providing a passageway for leakage flow, the impeller 118 replaces each slot 36 with a series of holes 136. Each series of holes 136 includes a plurality of holes 138. The holes 138 are axially aligned with one another and spaced-apart circumferentially from one another. The holes 138 extend through the shroud 30 to passively recirculate flow $F_3$, in the same manner as shown in FIG. 6. In this regard, the impeller 118 functions substantially equivalently to the impeller 18. The holes 138 may be formed by drilling, which may increase the ease of manufacturing the impeller 118 relative to when the impeller includes elongate slots 36. Within each series of holes 136, the holes 138 are spaced-apart from one another by a relatively small distance, such as about 0.25 mm, or about one-fourth of the diameter of the holes 138, which exhibit a diameter of about 1 mm in this example. Each series of holes 136 is circumferentially spaced-apart from an adjacent series of holes 136 by an amount greater than the diameter of the holes 138. In an example, each series of holes 136 includes between 8-10 of the holes 138. The number of holes 138 within each series of holes 136, and the relative spacing of the holes 138 and the series of holes 136 may be determined based on a desired quantity of recirculation flow.

It should be understood that terms such as "axial," "radial," and "circumferential" are used above with reference to the normal operational attitude of a compressor and with reference to the central axis of the compressor. The axial direction is generally labeled as "A" in some drawings and the radial direction is generally labeled as "R." Further, these terms have been used herein for purposes of explanation, and should not be considered otherwise limiting. Terms such "generally," "about," and "substantially" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A refrigerant compressor, comprising:

a shrouded impeller including a passageway permitting refrigerant to flow from a location radially outside a shroud of the shrouded impeller to a location radially inside the shroud, wherein the passageway is a slot, wherein the slot is spaced axially between a leading edge and a trailing edge of the shrouded impeller, wherein the shrouded impeller includes a plurality of main blades, wherein the shrouded impeller includes a splitter blade between adjacent ones of the main blades, and wherein the slot is arranged downstream of leading edges of the main blades and upstream of a leading edge of the splitter blade.

2. The refrigerant compressor as recited in claim 1, wherein the slot extends through the shroud at a non-90° angle relative to an axis of rotation of the shrouded impeller.

3. The refrigerant compressor as recited in claim 2, wherein the slot extends through the shroud at an angle substantially perpendicular to a contour of tips of blades of the shrouded impeller at an axial location of the slot.

4. The refrigerant compressor as recited in claim 1, wherein an outer wall of the shroud provides a portion of a seal assembly at an axial location between a leading edge of the shrouded impeller and the slot.

5. The refrigerant compressor as recited in claim 1, wherein the slot is one of a plurality of slots of the shrouded impeller.

6. A method, comprising:

operating refrigerant compressor including a shrouded impeller such that the shrouded impeller rotates within a housing; and directing leakage flow between the shrouded impeller and the housing back into the shrouded impeller through a passageway extending radially through a shroud of the shrouded impeller, wherein the passageway is a slot, wherein the slot is spaced axially between a leading edge and a trailing edge of the shrouded impeller, wherein the shrouded impeller includes a plurality of main blades, wherein the shrouded impeller includes a splitter blade between adjacent ones of the main blades, and wherein the slot is arranged downstream of leading edges of the main blades and upstream of a leading edge of the splitter blade.

7. The method as recited in claim 6, wherein the shroud is permanently attached to the impeller.

8. The method as recited in claim 6, wherein, during operation of the refrigerant compressor, the impeller and shroud rotate together with a shaft of the refrigerant compressor.

9. The refrigerant compressor as recited in claim 1, wherein the shroud is permanently attached to the impeller.

10. The refrigerant compressor as recited in claim 1, wherein the impeller and shroud are configured to rotate together with a shaft of the refrigerant compressor during operation of the refrigerant compressor.

* * * * *